United States Patent [19]

Faulkner et al.

[11] 4,006,376

[45] Feb. 1, 1977

[54] PHOTOTUBE HAVING IMPROVED ELECTRON COLLECTION EFFICIENCY

[75] Inventors: Richard Dale Faulkner; Robert Edwin McHose, both of Lancaster, Pa.

[73] Assignee: RCA Corporation, New York, N.Y.

[22] Filed: Feb. 28, 1975

[21] Appl. No.: 554,099

[52] U.S. Cl. ..... 313/95; 313/102

[51] Int. Cl.[2] ..... H01J 39/04; H01J 39/00

[58] Field of Search ..... 313/95, 94, 101

[56] References Cited

UNITED STATES PATENTS

| | | | |
|---|---|---|---|
| 2,487,665 | 11/1949 | Morton et al. | 313/94 |
| 2,908,840 | 10/1959 | Anderson | 313/95 X |
| 3,875,441 | 4/1975 | Faulkner | 313/95 X |

FOREIGN PATENTS OR APPLICATIONS

| | | | |
|---|---|---|---|
| 529,192 | 5/1957 | Belgium | 313/94 |
| 901,569 | 1/1954 | Germany | 313/95 |

*Primary Examiner*—Robert Segal
*Attorney, Agent, or Firm*—Glenn H. Bruestle; William H. Murray

[57] ABSTRACT

Photoelectrons emitted from a flat photocathode are collected within an evacuated envelope by a surface of an electrode. The photoelectrons are accelerated by an electron lens system, as an electron stream, within an evacuated cavity between the photocathode and the electrode surface. The photoelectrons are accelerated through two succeeding cavity regions in which the electron trajectories associated with the electron stream are increasingly compressed. A cavity region of lessening compression of the electron trajectories associated with the electron stream is defined between the two cavity regions of increasing compression. The electrode surface is located closely proximate to the cavity region of greatest compression to collect a maximum number of the photoelectrons.

4 Claims, 1 Drawing Figure

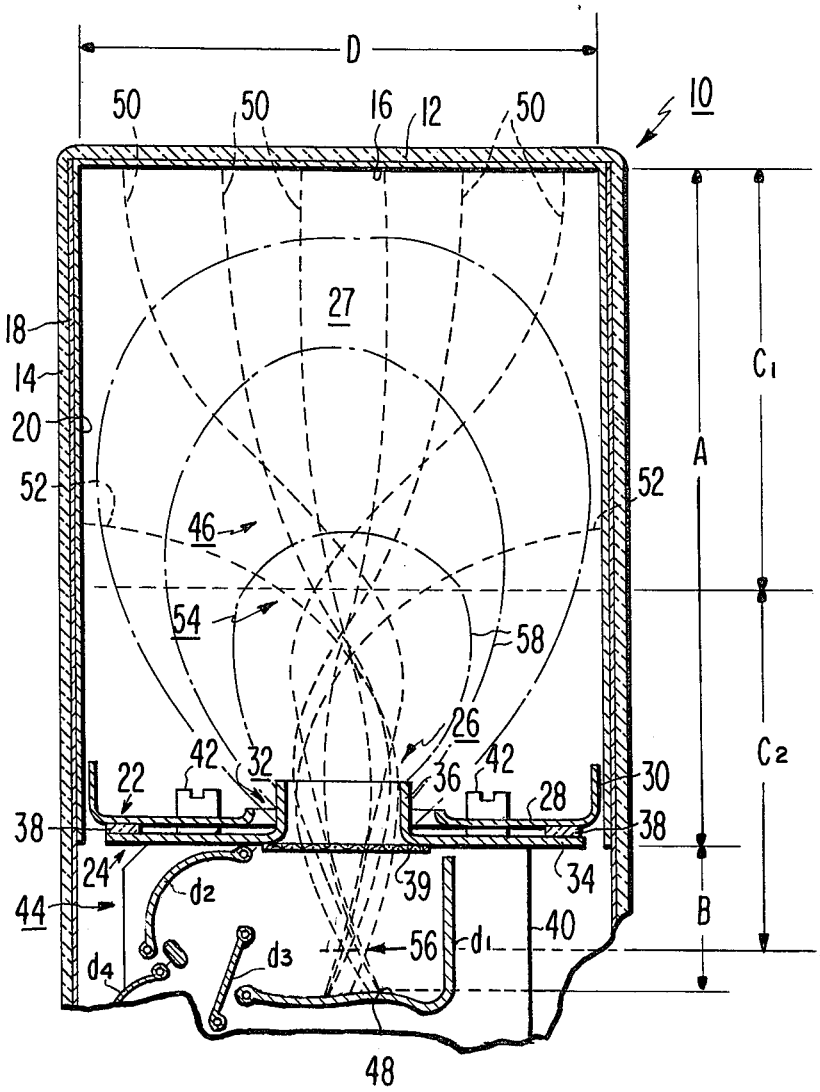
D
10
50
50
16
12
50
27
18
14
20
52
52
46
54
58
26
42
32
42
22
36
30
28
38
38
24
39
34
44
d2
40
B
d4
d3
56
d1
48
A
C1
C2

PHOTOTUBE HAVING IMPROVED ELECTRON COLLECTION EFFICIENCY

BACKGROUND OF THE INVENTION

The present invention relates to phototubes and more particularly to photomultiplier tubes.

A phototube is an electron discharge device which is particularly useful for detecting an input signal in the form of radiation, focused to impinge upon an input surface of that device. The input surface of such a device generally includes a photocathode within an evacuated envelope for converting radiation into a stream of electrons. An anode is provided for collecting the electron stream, generated within the evacuated envelope, and for providing an electrical output signal current related to real time magnitudes of the collected electron stream.

In photomultipliers, an electron multiplier is interposed within the electron stream between the photocathode and anode to provide, in ordered sequence, one or more electrode stages of electron multiplication. An electric field between the photocathode and the succeeding electrodes acts as an electron lens whereby the various electrons of the electron stream are accelerated as an electron bundle to impinge upon each of the succeeding electrodes in sequence.

Phototubes have generally been limited to their ability to most effectively convert incident radiation into useful anode output signal current. One reason for this limitation has been inability of one or more electrodes (anode or dynode) to completely collect the entire electron bundle consisting of the electrons emitted from the effective cathode surface(s) or a preceding dynode electrode surface. Theoretically, maximum collection of the electrons, or optimum signal output, occurs whenever all the emitted electrons are accelerated by electron lens system to impinge upon or be collected by an active region of a succeeding electrode. In practice, however, electron lens systems are deficient in that they are incapable of providing such optimum focussing of the entire electron stream. Such deficiencies of electron lens systems are particularly acute for phototubes wherein electrons are emitted from a flat photocathode and/or are emitted from the interior side walls of the tube. Furthermore, the actual surface area of the active collection region of succeeding electrodes is limited by internal tube design considerations, and/or other constraints to a total surface area considerably less than that necessary to collect all useable electrons emitted as a result of the input signal.

SUMMARY OF THE INVENTION

An electron discharge device includes an evacuated envelope having a transparent faceplate. A transmissive type photocathode on the faceplate surface within the interior of the envelope is provided for emitting photoelectrons in response to light focussed to impinge thereon. An electrical output means is provided for collecting photoelectrons in the form of an electron bundle, and for generating an electrical output signal responsive to the collected photoelectrons. The photoelectrons are accelerated by an electron lens system from the photocathode through an electron acceleration cavity to impinge upon an active surface region of a collection electrode of the electrical output means. The electrical output means may comprise an electron multiplier. The electron lens system focusses the photoelectrons as an electron bundle to a plurality or series of separated cavity regions in which the electron trajectories associated therewith are increasingly compressed. The regions of compression of the electron bundle are separated by cavity regions in which the electron trajectories associated with the electron stream are of lessening compression. The active surface region of the collection electrode is positioned to intersect the electron bundle downstream of the first region of compression to improve the overall collection efficiency of the device.

BRIEF DESCRIPTION OF THE DRAWING

The FIGURE of the drawing is a partial cross-sectional view of a photomultiplier tube made in accordance with the invention.

DESCRIPTION OF THE PREFERRED EMBODIMENTS

Referring now to the drawing, there is shown an input portion of a "head on" type photomultiplier tube 10 in which the input surface of the device comprises a substantially flat transparent glass faceplate 12 of an evacuated envelope 14. A transmissive type semitransparent photocathode 16 is provided on a surface of the faceplate 12 within an evacuated interior of envelope 14. Such photocathodes are well known in the art and may comprise photoemissive material compositions such as, for example, disclosed in U.S. Pat. No. 2,914,690, issued to A. H. Sommer on Nov. 24, 1959. The envelope 14 also includes a tubular central portion having an interior elongated side wall surface portion with an aluminized coating 18. The interior surface of coating 18 is preferably cylindrical and includes a photocathode 20 of a reflective type, comprising a photoemissive material composition similar to that of photocathode 16.

An electron multiplier 44 is coaxially secured within the evacuated interior of envelope 14 in spaced-apart relation to the photocathode 16 by means of lead wires (not shown) secured to a plurality of lead-in pins protruding through a stem region of the tube 10 (not shown) in a manner well known in the art. A pair of annular electron focusing, or field forming electrodes 22 and 24 are secured to one end of electron multiplier 44, coaxially within the evacuated interior of the tubular portion of envelope 14, facing the photocathode 16. The interior surfaces of photocathodes 16, 20 and the surfaces of electrodes 22 and 24 facing the faceplate 12 together substantially enclose a portion of an evacuated electron acceleration cavity 27.

Electrode 22 is cup-shaped and includes a substantially flat apertured disc-shaped portion 28, and an outer lip or cylindrical flange portion 30 extending approximately perpendicular from the flat portion 28 toward the faceplate 12. Electrode 24 includes a substantially flat disc-shaped portion 34, and an inner lip or cylindrical flange portion 36 extending approximately perpendicular from the flat portion 34 toward the faceplate 12. Disc-shaped portion 28 includes a central aperture 32 having dimensions slightly exceeding the outer dimensions of the cylindrical flange portion 36 of electrode 24. The cylindrical flange portion 36 of electrode 24 extends telescopically through aperture 32 of electrode 22 such that disc-shaped portions 28 and 34 are closely positioned in facing approximately parallel spaced-apart relation to each other. The facing surfaces of disc-shaped portions 28 and 34 are spaced-apart in aligned substantially parallel relation to each other by rectangular ceramic spacers 38 interposed between their facing substantially flat disc-shaped surfaces. An electron permeable aperture 26 extends centrally through the flange portion 36 of electrode 24 and is covered by, and is electrically connected to, a substantially flat electron permeable mesh or grid 39.

Electrodes 22 and 24 are secured within the evacuated interior of tube 10 by means of an electrode support structure of the electron multiplier 44 including substantially parallel spaced-apart substantially flat ceramic electrode mounting spacers 40, one of which is depicted in the drawing. The support spacers 40 are securely fastened to the field forming electrodes 22, 24 by means of a plurality of tabs 42 which protrude through, and are secured within, slotted regions in each of the respective field forming electrodes 22 and 24.

Electron multiplier 44 includes a plurality of electrodes mounted between the inner facing surfaces of the parallel support spacers 40 in a manner well known in the art. The electrodes of the multiplier may include, for example, a series of dynode electrodes $d_1$–$d_n$ ($d_5 14$ $d_n$ not shown) and an anode (not shown) wherein $n$ symbolizes the number of dynode electron multiplication stages desired.

Various types of electron multiplier constructions may be employed in tube 10 to advantage, and their construction and operation is well known to persons skilled in the art of electron discharge devices. For example, such devices may be constructed with their dynodes arranged in a circular cage fashion, as partially depicted in FIG. 1, or as an elongated staggered series of dynodes, as for example, shown in U.S. Pat. No. 2,908,840 issued to R. H. Anderson on Oct. 13, 1959.

During operation of tube 10, appropriate electric potentials must be applied to each of the respective electrodes of tube 10, and photocathodes 16 and 20. Such potentials may, for example, be applied by means of the lead wires (not shown) connected to the lead in pins which protrude from the stem portion of the tube 10 (not shown) in a manner well known in the art.

In the operation of the tube 10, the photoemissive material of photocathodes 16 and 20 act as sources of photoelectrons. Photoelectrons are emitted as a stream of electrons from the photoemissive material of each of the photocathodes 16 and 20 in response to light which impinges thereon. These photoelectrons of each electron stream are merged, or concentrated within the central portion of cavity 27 and are accelerated as a single electron bundle 46 through electron permeable aperture 26 in electrode 24 to impinge upon the dynode $d_1$.

Electron acceleration from photocathodes 16, 20 to dynode $d_1$ is accomplished by means of an electric field created within the portion of the electron acceleration cavity 27 during the operation of the tube between the electron emitting surfaces of photocathodes 16 and 20 and the electron muliplier 44. This electric field is electrostatically generated by an electron lens system of the tube 10 which primarily comprises: the photocathode 16; the aluminized coating 18 and the photocathode 20 thereon; the field forming electrodes 22, 24; and the dynode $d_1$. In general, the electric field may also be generated by magnetic and/or electrostatic means, as is well known in the art of electron discharge devices.

Referring to the drawing, several typical electron trajectories 50 and 52 are depicted for photoelectrons which are emitted from the photocathode 16 and 20, respectively, as streams of electrons into cavity 27 whenever a uniform input light signal is scanned across or focussed over the entire input surface of faceplate 12 of an operative tube 10.

In order to generate a useful anode output signal current from the operative tube, the emitted photoelectrons must impinge upon the "active" input surface 48 of (i.e. be collected by) the dynode $d_1$. The "active" surface comprises a surface region of dynode $d_1$ from which secondary electrons may be generated, and from which the secondary electrons may then be properly accelerated as an electron stream to other ones of the electrodes (dynodes $d_2$–$d_n$), in ordered sequence, for ultimate collection by the anode. Ideally, all emitted photoelectrons are electrostatically accelerated as part of the electron bundle 46 to impinge upon active region 48. In practical devices, however, the physical area of the active input surface 48 upon which electrons must impinge, is considerably less than that necessary to properly collect all the emitted photoelectrons. As a consequence of this deficiency, undesirable variations in the anode output signal current occurs for a given input photoevent depending upon the point or region of the photocathode upon which it impinges.

Referring to the drawing, the electron lens system of tube 10 is designed to improve the focus of the electron stream(s) of the emitted photoelectrons into a single electron bundle 46 to impinge upon the active region 48 of dynode $d_1$ with increased concentration of the electron trajectories associated therewith.

The electron lens system of tube 10 is constructed to generate an electric field defining a series of "tear-drop" shaped or "pear" shaped lines of equipotential. Typical field lines of equipotential 58 are, for example, depicted in the drawing. The "tear-drop" shaped field lines 58 generally include a globular portion which extends upwards toward the photocathode 16, and a narrow truncated portion which terminates on the cylindrical flange portion 36 of electrode 24, or the surface 48 of dynode $d_1$. As a consequence of the electric field described, the electron lens focusses the emitted photoelectrons during operation of the tube 10 in a manner roughly analogous to the focusing of a light image by two spaced apart consecutive lenses. Because of the symmetry of the electron lens system of tube 10, the central axis of the field lines 58 corresponds to the central axis of the electron trajectories associated with the electron stream 46; however, asymmetrical fields may also be employed to advantage.

The electron bundle 46 is multiply focused by the electron lens system to define a plurality, or series, of spaced-apart electron-crossover regions 54 and 56 (i.e. the general regions of the cavity 27 wherein the electron trajectories cross). As a result of multiple focusing of the electron bundle 46, certain elongated portions of the bundle 46 in the direction of general electron propagation define cross-sectional regions of convergence or compression of the electron trajectories contained therein.

A region of convergence, as herein defined, comprises an elongated cavity region having associated therewith increasing concentration or compression for a fixed significant proportion of the electron trajectories associated with the electron bundle 46. More specifically, in the tube 10, a region of convergence of the electron bundle 46 comprises, generally, a substantially frustum-shaped cavity region having decreasing circular cross-sections which perpendicularly and centrally intersect a central axis of propagation of a fixed significant proportion of the electron trajectories which are associated with the electron bundle 46 and which may be generated by a complete scan of photocathode 16 and 20 with an input light signal or photoevent. Each successive or "downstream" cross-sectional region of convergence of the electron bundle 46 defines a cross-sectional region of greater concentration of the electron trajectories contained therein than that of the immediately preceding or "upstream" region in closer proximity to the input portion of the tube upon which the light input signal impinges (i.e. the faceplate 12). Successive elongated regions of convergence of the electron bundle 46 are interrupted by elongated regions of divergence of the electron trajectories associated with the electron bundle 46.

In prior art devices, the active surfaces of dynodes similar to $d_1$ are positioned substantially parallel to the faceplate along a plane substantially intersecting the first cross-sectional region of convergence of the electron bundle at a region of greatest convergence or concentration of the electron trajectories contained therein (i.e. closely proximate to the first electron-crossover region analogous to region 54). In contrast, the dynode $d_1$ of tube 10 is positioned in accordance with the invention such that its active surface 48 interrupts the electron bundle 46 "downstream" from the first cross-sectional region of convergence at a distance further removed from the faceplate 12. Preferably, the active surface of dynode $d_1$ is located as shown in the drawing, substantially along a plane intersecting the electron bundle 46 closely proximate to the second cross-sectional region of convergence; however, the active region 48 may intersect the electron bundle 46 to advantage at any region downstream of the first region of convergence having associated therewith a greater concentration of the electron trajectories than that associated with the first region of convergence.

The compression or concentration of electron trajectories of emitted photoelectrons associated with a particular circular cross-sectional area of intersection of the second region of convergence of electron bundle 46 is significantly greater than within an analogous area associated with the first region of convergence. Thus, for a given cross-section of the electron bundle 46 within the second region of convergence, an equivalent proportion of electron trajectories may be confined within a significantly smaller cross-sectional area than that associated with an analogous area of the first region of convergence.

Furthermore, the provision of a second region of convergence for electron stream 46 between the electron source and the first electrode, provides a means whereby a significantly greater proportion of the photoelectrons may be properly collected by an active surface region of that electrode having the same physical dimensions as that formerly utilized in the prior art. The increased focusing accuracy resulting from greater compression of the electron trajectories of the electron bundle 46 permits considerably increased efficiency in converting emitted photoelectrons into a useful electrical output signal current at the anode.

Relatively minor changes in the electron lens system of a phototube are necessary to accelerate emitted photoelectrons to a second region of greatest compression of the electron trajectories associated with electron bundle 46. Compared with analogous prior art photomultipliers, the tube 10 differs in that it includes an electron acceleration cavity 27 of greater elongation, and a pair of field forming electrodes 22 and 24 for generating the necessary electric field within the cavity 27 as previously described. For example, an operative embodiment of the tube 10 may comprise a tube having thefollowing approximate dimensions as contrasted with an analogous prior art device having the approximate illustrative dimensions noted:

| Dimension | Definition | Photomultiplier 10 | Analogous Dimension For Prior Art |
|---|---|---|---|
| A | Distance from photocathode 16 to focusing electrode 24. | 60 mm. | 35 mm. |
| B | Distance from focusing electrode 24 to active region 48. | 10 mm. | 10 mm. |
| $C_1$ | Distance from photocathode 16 to first region of greatest compression of electron trajectories associated with the electron bundle 46. | 37 mm. | 35 mm. |
| $C_2$ | Distance from the first region of greatest compression of electron trajectories associated with electron bundle 46 to the second region of greatest compression. | 30 mm. | not applicable |
| D | Diameter of faceplate 12. | 47 mm. | 47 mm. |

We claim:

1. An electron discharge tube comprising a. a hermetically sealed evacuated envelope having a transparent faceplate portion with a transmissive photocathode on said faceplate portion having a substantially planar electron emissive surface within the interior of said envelope capable of emitting photoelectrons as an electron stream in response to radiation impinged thereon, b. an elongated tubular portion extending from said faceplate portion;

c. electrical output means spaced from said photocathode capable of collecting said emitted electrons as an electron stream, and of providing an electrical output signal responsive to said collected electron stream, said means including an active surface collection region of an electrode upon which photoelectrons may be primarily accelerated to impinge;

d. a cylindrically shaped evacuated electron acceleration cavity between said photocathode and said active surface collection region partially enclosed by a side wall surface of the tubular portion of the envelope;

e. said side wall surface including a coating of a photocathode material capable of emitting photoelectrons in response to radiation impinged thereon, electrically connected to the photocathode;

f. an electron lens system capable of generating an electric field which includes a series of field lines of equipotential, substantially tear-drop shaped, and symmetrical about a central axis within said cavity corresponding to a central axis of propagation of said photoelectrons therein; said lens having at least a pair of field forming electrodes, one of said electrodes coaxially mounted within the interior of said tubular portion of said envelope with a central opening covered by a wire mesh through which the photoelectrons may be accelerated to impinge upon said active surface region;

one of said electrodes includes a planar major surface facing and substantially parallel with the electron emissive surface of said photocathode, with a tubular portion which extends toward the faceplate portion; and g. said lens being capable of focussing said photoelectrons as an electron bundle to intersect in sequence at least two spaced apart regions of said cavity in which electron trajectories associated with said accelerated photoelectrons are increasingly compressed, said electron trajectories defining a region of lessening compression between said spaced apart regions of increasing compression, the final region of compression including electron trajectories of significantly greater compression than that associated with said first region of compression, said active surface collection region being located substantially along a cross-sectional plane intersecting said electron bundle along said final region of compression.

2. An electron discharge device in accordance with claim 1, wherein a major surface of the second of said field forming electrodes is mounted closely in facing spaced-apart electrical insulated relation to a major surface of said first field forming electrode not facing said faceplate.

3. An electron discharge device in accordance with claim 2, wherein said second field forming electrode includes a tubular portion having a central aperture therethrough covered by a wire mesh, said tubular portion extending through a central aperture in said first field forming electrode.

4. An electron discharge device in accordance with claim 3, wherein said electrical output means comprises an electron multiplier and wherein said electrode including said active surface collection region consists of the first dynode of said electron multiplier.

* * * * *

UNITED STATES PATENT OFFICE
CERTIFICATE OF CORRECTION

PATENT NO. : 4,006,376

DATED : February 1, 1977

INVENTOR(S) : Richard Dale Faulkner et al.

It is certified that error appears in the above-identified patent and that said Letters Patent are hereby corrected as shown below:

Column 3, line 23, "($d_5$14" should read --($d_5$— --.

Signed and Sealed this

Nineteenth Day of April 1977

[SEAL]

*Attest:*

RUTH C. MASON
*Attesting Officer*

C. MARSHALL DANN
*Commissioner of Patents and Trademarks*